US005312015A

United States Patent [19]

Gelzer

[11] Patent Number: 5,312,015

[45] Date of Patent: May 17, 1994

[54] GATED-LOOP PACKAGING SYSTEM AND MANIPULATING APPARATUS

[75] Inventor: John R. Gelzer, Dublin, Ohio

[73] Assignee: GPAX International, Inc., Columbus, Ohio

[21] Appl. No.: 862,640

[22] Filed: Apr. 3, 1992

[51] Int. Cl.[5] ..... B65D 73/00

[52] U.S. Cl. ..... 221/72; 206/330; 206/461; 206/345; 221/84

[58] Field of Search ..... 414/403, 411; 221/70, 221/71, 72, 74, 82, 84, 87; 206/330, 345, 347, 461, 467

[56] References Cited

U.S. PATENT DOCUMENTS

| | | | |
|---|---|---|---|
| 3,048,268 | 8/1962 | Rocchi et al. | 221/72 |
| 3,212,669 | 10/1965 | Kruger | 221/70 |
| 4,583,641 | 4/1986 | Gelzer | 206/329 |
| 4,621,486 | 11/1986 | Slavicek | 206/330 |
| 4,631,897 | 12/1986 | Slavicek | 206/330 |
| 5,086,947 | 2/1992 | Bragaglia | 414/403 |
| 5,119,934 | 6/1992 | Karasawa et al. | 206/330 |

*Primary Examiner*—H. Grant Skaggs
*Attorney, Agent, or Firm*—Robert E. Stebens

[57] ABSTRACT

A tape-form packaging system is provided having an elongated carrier tape on which a plurality of elongated article-receiving loops are mounted on a face of the tape in transversely oriented relationship to the longitudinal axis of the tape with the axial ends of the loops spaced a distance inwardly from the longitudinal edges of the tape. Gating elements are affixed to the carrier tape with a gating element positioned between each axial end of a loop and the adjacent longitudinal edge of the carrier tape and operative to block axial movement of an article into or out of the respective loop. The carrier tape is flexible and upon flexing of the marginal edge portion of the tape, the gating element is displaced out of blocking relationship to the loop permitting axial displacement of an article into or out of a loop.

A tape-manipulating apparatus is provided for flexing of a marginal longitudinal edge portion of a strip-form tape packaging system to temporarily remove a gating element from blocking relationship with respect to a respective article-receiving loop. Guide rails are provided to engage with the longitudinal edges of the tape as it passes through an article-transfer station to prevent displacement of the tape in its plane transversely to its longitudinal axis and to restrain the tape against displacement laterally with respect to its plane. A bending rail is positioned in the article-transfer station to bring an edge of the rail that is inclined to the path of movement of the tape into contacting engagement with the tape and effect flexing of a marginal edge portion of the tape a sufficient distance out of the plane of the tape as to displace the gating elements out of blocking relationship to an axial end of a respective loop. An elongated back-up rail is supported in contacting engagement with the face of the tape opposite the loops and at a position to maintain the loops in a planar path of movement through the article-transfer station.

31 Claims, 10 Drawing Sheets

GATED-LOOP PACKAGING SYSTEM AND MANIPULATING APPARATUS

FIELD OF THE INVENTION

This invention relates in general to a packaging system having particular utilization in the area of automated processing apparatus and equipment. It relates more specifically to a packaging system having an elongated carrier tape of flexible material that carries a series of longitudinally spaced loops for receiving the articles to be packaged in association with the carrier tape and respective gating elements associated with each of the loops for maintaining the articles in the loops and being selectively operable to an open position whereby articles may be inserted or removed from the loops. It also relates to apparatus for manipulating of the carrier tape in effecting flexing of the tape to displace the gating elements to a position where they do not interfere with movement of articles into or out of the loops.

BACKGROUND OF THE INVENTION

Manufacturing operations very frequently involve assembly of a number of components into a finished product unit. It is highly advantageous from an economic standpoint to automate as many as possible of these assembly operations and, in particular, it is advantageous to provide apparatus and mechanisms that enable mechanized delivery or assembly of components or subcomponents of an assembly at least to the extent of providing those components at a work station where personnel may manually effect the assembly. Even more advantageously, it is desirable that automated mechanisms including robotics may effect the assembly once provided with the component and effect the placement of that component in association with either a subassembly or major component of a product unit.

Packaging systems designed to meet this general objective have been heretofore designed and utilized. These packaging systems generally comprise elongated flexible tapes of strip-form that are readily rolled or folded into compact packages for both economy of storage space and also minimizing transport costs. A previously patented example of a packaging system of this type is disclosed in U.S. Pat. No. 4,583,641 granted Apr. 22, 1986 to John R. Gelzer, the named inventor in this application. That prior art packaging system consisted of an elongated carrier tape to which a secondary or packaging tape was removably secured and the two tapes cooperatively retained articles in loop-form assemblies. The packaging tape was mechanically interconnected to the carrier tape by means which enabled the two to be readily separated at the assembly or utilization point and thereby release the article or component previously retained with the packaging system. Such a packaging system as shown in this identified patent required that the two tapes be mechanically joined while concurrently receiving the articles to be packaged. At the point of utilization of the articles, the two tapes were mechanically separated and if desired, the tapes could either be reused by returning them to the source of supply for the articles and reassembled in packaging of additional articles. Alternatively, they could be simply shredded and the material then disposed of or recycled through remanufacture into new tapes for subsequent use in packaging of other articles for storage and transport to the utilization station.

SUMMARY OF THE INVENTION

In accordance with this invention, a flexible tape-form packaging system is provided in which compartments are formed for receipt and retention of the articles to be packaged and transported with elements associated with the tape that serve to selectively permit either insertion of the articles into the tape packaging system or to selectively permit removal of those articles at the point of utilization. The packaging system of this invention includes a carrier tape comprising an elongated, flexible strip of material, such as a suitable plastic, to which are affixed a plurality of article-receiving loops disposed in serially spaced relationship along the longitudinal axis of the carrier tape. The article-receiving loops form in cooperation with the carrier tape elongated tubular cavities for receiving the articles or components with the ends of these loops being open to permit insertion and removal of the articles from the loop that is thus formed. Gate elements are formed with or affixed to the carrier tape with a respective gate element positioned in axial alignment with the tubular cavity of the loop and are operable to effect closing of the loop and preventing either insertion or removal of the article from the respective loop. In a basic form of the invention, the loops are formed by a tape of flexible construction having elements which mechanically cooperate with apertures formed in the carrier tape to effect secure interlocking of those components. It is not necessary that the tapes be disassembled with this invention and the loops may be permanently secured to or integrally formed with the carrier tape. The gating elements may be integrally formed in the carrier tape and through manipulation of the proximate portions of that tape are displaced into a relative position where they do not block the open ends of the tubular cavities formed by the loops.

Placement of articles within the loops or subsequent removal therefrom at respective filling or utilization stations is mechanically effected by mechanical structures and mechanisms which function in cooperation with the longitudinal displacement of the tape to effect manipulation of the gating elements to a position where they are not in axially blocking relationship to a respective open end of a loop. In one example of utilization of the packaging system of this invention, the packaging system may be supported with the carrier tape disposed in a vertical plane whereby the articles can be readily inserted into respective loops by gravity feed systems and to then be subsequently removed again by gravity feed systems at the utilization station. An advantage of this packaging system is that it retains the articles in a desired orientation that is designed to be compatible with automated apparatus at the utilization station to facilitate subsequent assembly of the component with a subassembly or unit that is being assembled. This packaging system enables the component to be delivered from the tape at a precise location such as into association with the automated assembly mechanisms.

In accordance with another aspect of this invention, apparatus is provided for effecting manipulation of the carrier tape in a manner to displace the gating elements to a position with respect to a loop whereby an article may be inserted into the loop or removed therefrom as at either a loading or a dispensing station. The manipulating apparatus is of a passive type which effects displacement of the carrier tape through relative movement of the tape in cooperative contacting engagement with components of the apparatus as the carrier tape is incrementally advanced in bringing successive loops to either an article loading station or to a dispensing station. In the illustrative embodiment of this apparatus, a bending rail is supported in a fixed position with respect to the loading or dispensing station to progressively displace a marginal edge portion of the tape out of the plane of the tape and thereby concurrently displace an associated gating element out of the axial path of movement of an article into or out of the respective loop. To assure that a gating element is fully displaced to a noninterfering position, a secondary bending surface is provided in combination with the bending rail and is positioned to contactingly engage with the gating elements. This secondary bending surface is also of a passive nature and functions to bend a gating element with respect to the carrier tape for the purpose of reducing the extent to which the carrier tape may be required to be flexed.

These and other objects and advantages of this invention will be readily apparent from the following detailed description of illustrative embodiments of the invention and the accompanying drawings.

DESCRIPTION OF THE DRAWING FIGURES

DESCRIPTION OF THE ILLUSTRATIVE EMBODIMENTS OF THE INVENTION

Figure 1:
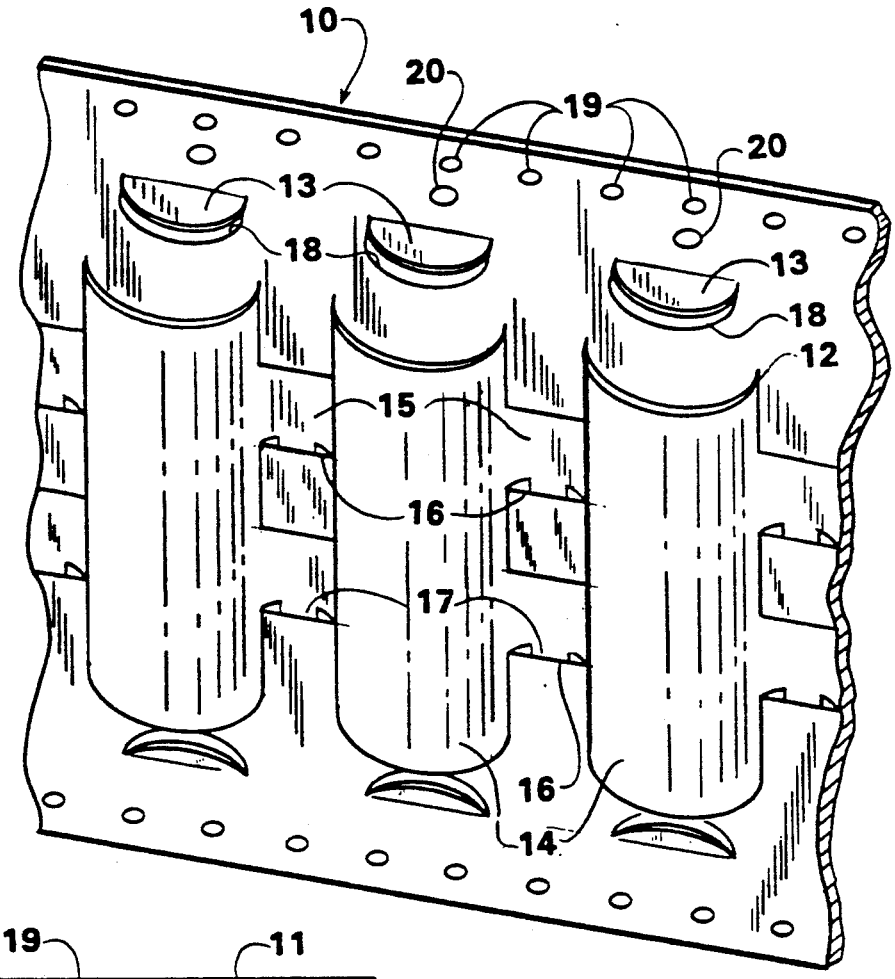
FIG. 1 is a perspective view of a length of a packaging system embodying this invention.
Figure 2:
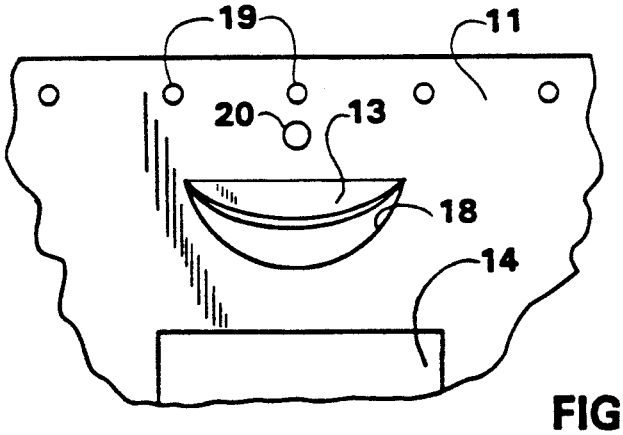
FIG. 2 is a fragmentary elevational view of a front surface of the packaging system shown in FIG. 1.
Figure 3:
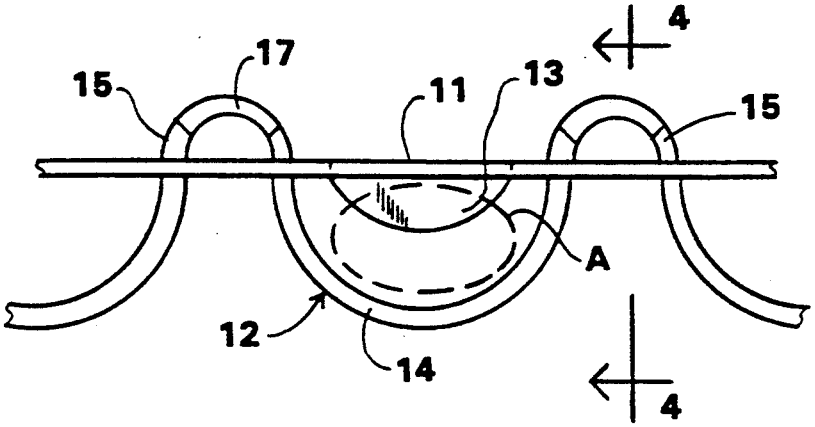
FIG. 3 is a fragmentary top plan view of the packaging system as shown in FIG. 1.
Figure 4:
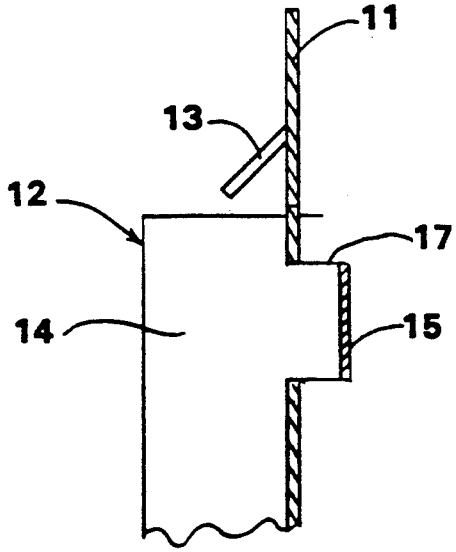
FIG. 4 is a fragmentary sectional view taken along line 4—4 of FIG. 3.

Having reference to FIGS. 1–4, a basic packaging system of this invention designated generally by the numeral 10 is shown in a vertical planar orientation as would be appropriate for either the filling of the tape with the articles or for subsequent removal of the articles from the tape. The packaging system 10 with the articles packaged therewith may be otherwise oriented such as being rolled into a compact reel and placed in an auxiliary packaging structure for storage and transport purposes. Each packaging system that comprises a unitary assembly or package unit would thus include a plurality of the structures for retention of the articles with the length of a unit being determined by the physical capabilities of a packaging structure and appropriate size for convenience of handling. Each packaging system unit is adapted to be fed into mechanical apparatus to effect either the placement of articles into packaged association with the system or to permit removal of those articles at a utilization station. Each packaging system unit which is of a predetermined configuration suitable for the specific application may be serially fed through those mechanisms with subsequent packaging system units either being joined to a preceding unit or being mechanically positioned to be serially fed through the article placement or removal mechanisms with appropriate continuity for efficient operation of the associated components of such a system.

The basic embodiment as shown in FIGS. 1–4 comprises a carrier tape 11, a loop tape 12 and a plurality of gating elements 13. The carrier tape 11 is formed from a strip of suitable plastic material having appropriate characteristics of flexibility and structural strength. It is of a width that is sufficient to accommodate the length of the particular articles that are to be packaged therewith and to enable functioning of the gating elements as well as manipulation of the carrier tape or packaging system through the mechanical utilizing elements. As will be readily understood in subsequent specific description of the functioning of the packaging system, this carrier tape is of a thickness for the particular type of plastic material from which it is formed as to provide necessary structural rigidity during transport movements, but to still enable mechanical manipulation or deformation to effect functioning and operation of the gating elements with respect to the loop tape.

The loop tape 12 is also formed from an elongated strip of appropriate plastic material exhibiting adequate structural strength and resilient flexibility to enable assembly with the carrier tape 11. The loop tape 12 and carrier tape may be formed in a manner similar to the tapes shown in U.S. Pat. No. 4,583,641. Portions of the loop tape 12 designated as the loops 14 are oriented to extend transversely with respect to the longitudinal axis of the carrier tape and are disposed in longitudinally spaced relationship. They are interconnected by attaching loops 15 with two attaching loops 15 provided between each of the loops 14 with those attaching loops designed to mechanically interconnect with the carrier tape 11 by insertion through respective apertures 16 formed in the carrier tape. The attaching loops are configured to have interlocking tabs 17 that may be forced through the respective apertures 16 and when thus assembled, will form a mechanical interlock and hold the loop tape 12 in association with the carrier tape 11. In this illustrative embodiment, the loop tape 12 is shown as having two attaching loops 15 formed between adjacent loops 14, but the number may be other than two as is determined by the respective width of the carrier tape 11 and the width of the associated loop tape 12. For substantially long articles, it may be advantageous to have the tapes constructed with more than two attaching loops and for short articles, one attaching loop may be adequate.

With utilization of the attaching loops 15 and appropriate dimensioning of the portions of the loop tape 12 that form the loops 14, it is possible to form a tubular loop having a desired cross-sectional area that is appropriate for the particular article with which the packaging system is to be utilized. The loops 14 are open at each end and thus articles may be inserted or removed from either end of the loop. While the drawings illustrate the loops 14 as being of a semicircular or U-shaped cross-section, the loops may be otherwise configured to best interfit with the articles to be packaged. For example, the loop tape may be fabricated from a material that is heat formable and susceptible to retaining a specific configuration into which it may be shaped when subjected to appropriate conditions of heat and pressure. The loops 14 may be formed into shapes having cross-sectional configurations of diverse geometrical shapes or may have irregular shapes designed to closely interfit with an article having a similar cross-sectional shape for the purpose of maintaining the article in a specific angular orientation with respect to its longitudinal axis.

The gating elements 13 in this embodiment are integrally formed with the carrier tape 11. They are formed as by die cutting semicircular segments 18 in the carrier tape in axially aligned relationship to a respective loop 14, or to the central axis of a prospective loop's position in the event that the loop tape 12 is attached to the carrier tape 11 after the segments 18 are cut for the gating elements 13. After being cut, the gating elements 13 are then subjected to a forming operation which may include the application of heat in combination with mechanical force to bend the element out of plane of the carrier tape to an angular position such as that shown in FIG. 4. This forming operation is designed to result in the element remaining in this angled position until such time as it may be subjected to a mechanical displacing force. The axially displaced position of a gating element relative to the end of a loop 14 may be other than as shown in FIGS. 1–4. It may be located either closer to the end of the loop or positioned further outward. The gating elements may also be cut with different configuration and dimension. Regardless of the axial positioning of the gating elements or their configuration or dimensions, the elements are designed for each application to function in cooperative relationship with the loops 14 and the articles to retain the articles in the loops, but susceptible of displacement to a position that permits either insertion of an article into a loop or to permit its removal.

Figure 5:
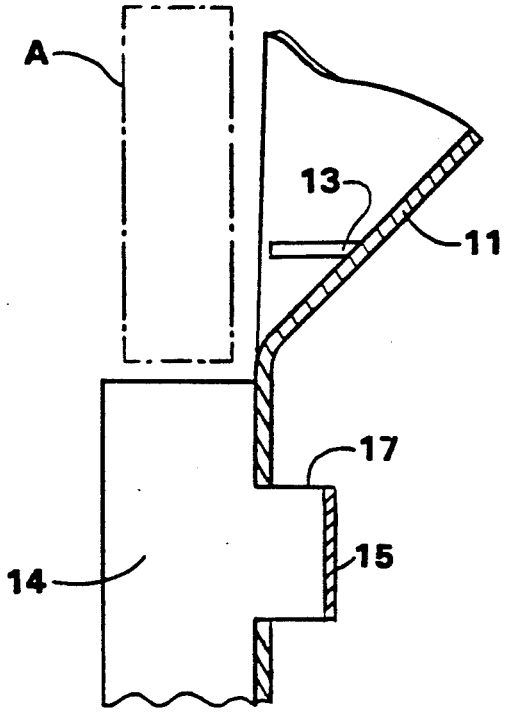
FIG. 5 is a fragmentary sectional view similar to FIG. 4, but showing a marginal edge portion of the carrier tape manipulated to a position whereby the gating element is displaced to an inoperative position with respect to the loop.

Functioning of the packaging system 10 to enable either insertion or removal of an article from a respective loop is diagrammatically illustrated in FIG. 5. The system is shown in FIG. 5 as would be appropriate for vertical orientation of the tape 11 and the loops 14 to permit gravity feeding of an article generally designated by the letter A into, or from, a respective loop 14. It will be understood that a reversal of this feeding operation would be associated with the opposite end of a respective loop and permit removal of the article from the respective loop such as at a utilization station. The functioning of the tapes, as indicated, is diagrammatically illustrated in FIG. 5 as with the carrier tape 11 being manipulated by mechanical means such as that which is described in subsequent paragraphs and is shown with a marginal edge portion of the carrier tape laterally displaced from the normal plane of the tape. This deformation or manipulation of the carrier tape results in simultaneous movement and displacement of a respective gating element 13 to a position where it is also laterally spaced with respect to the longitudinal axis of a loop and is thus in a noninterfering position to the path of movement of an article A into or from a loop. As will be described in subsequent paragraphs, mechanisms are utilized which will provide for secure positioning of the carrier tape in a vertical plane, but enabling the appropriate portion of the marginal edge of the carrier tape associated with a loop to be manipulated as shown in FIG. 5 to place the gating element in a noninterfering position. Feeding of a carrier tape 11 along a longitudinal path may be expeditiously effected by sprocket wheel mechanisms having pins adapted to be inserted in sprocket holes 19 that are serially formed along a marginal edge of the carrier tape. Use of sprocket wheel mechanisms enables the carrier tape to be precisely fed with respect to the mechanisms that effect either feeding of articles into or removal of the articles with respect to the tape as well as to properly index the tape into desired alignment with the related mechanisms and to also displace it in association with the mechanism that effects manipulation of the marginal edge portion of the carrier tape. Automated indexing of the tape to a loading or unloading station can be readily accomplished by indexing sprocket drive mechanisms known to those skilled in this art. To enable their functioning with the tape 11, a sensor target in the form of an indexing aperture 20 is formed in the marginal edge portion of the carrier tape in axial alignment with and at each loop 14.

The packaging system of this invention has been described as utilized in a manner whereby gravitational force only effects displacement of the articles into or out of the loops 14. However, the force of gravity may be supplemented or even replaced by mechanical or pneumatic devices which are capable of operating on or cooperating with an article to effect its axial displacement with respect to a loop. Utilization of mechanical or pneumatic displacing devices or mechanisms can provide a more reliable means for displacement of the articles and can assure positive displacement at an indexed location of the tape. Use of positive displacing devices or mechanisms also enables orientation of the tapes in planes other than vertical. Orientation in a horizontal plane is feasible. Illustration or further description of specific mechanical or pneumatic displacement devices or mechanisms is not provided as their detailed disclosure is not appropriate or necessary for full understanding of this invention of a gated loop packaging system or the associated tape manipulating mechanism.

Figure 6:
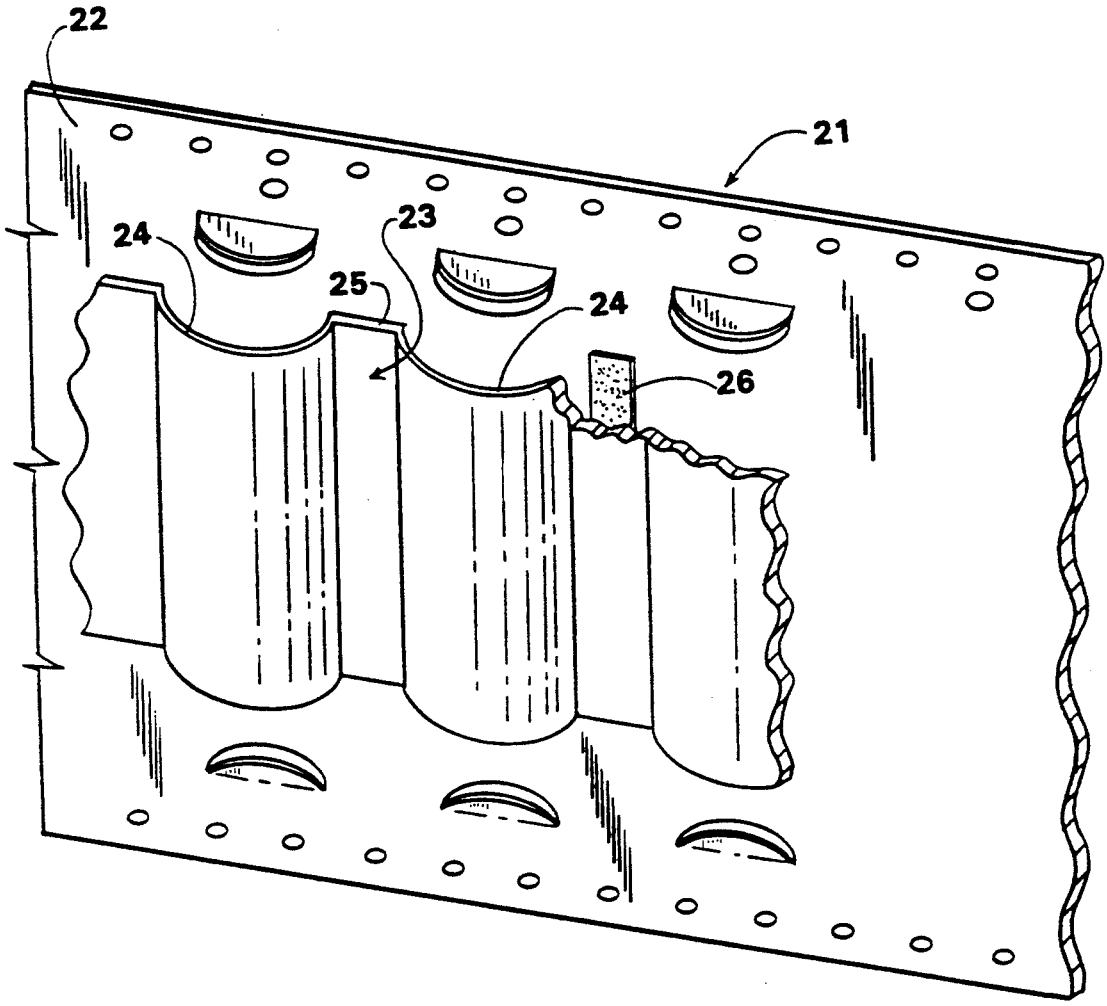
FIG. 6 is a perspective view of a section of a modified packaging system.

The embodiment of the packaging system 10 shown in FIGS. 1–4 utilizes mechanical interlocking of the carrier tape 11 and the loop tape 12. While mechanical interlock permits disassembly of the tapes, disassembly serves no function in utilization of this packaging system. If desired, the two tapes may be secured together as in the modified packaging system 21 shown in FIG. 6. This modified system includes a carrier tape 22 and loop tape 23 that is configured to form serially disposed loops 24 for receiving articles to be packaged. Each of the loops 24 is interconnected with an adjacent loop by an intergrally formed, flat web 25 adapted to be disposed adjacent the opposed surface of the carrier tape and is secured thereto by, for example, a layer of adhesive 26. The adhesive may be of a type that forms a substantially permanent bond between appropriate plastic materials from which the tapes are fabricated. Thermal or sonic welding techniques may also be used. A plurality of gating elements 27 of the same configuration as shown in the FIG. 1 embodiment are included in this FIG. 6 embodiment.

Figure 7:
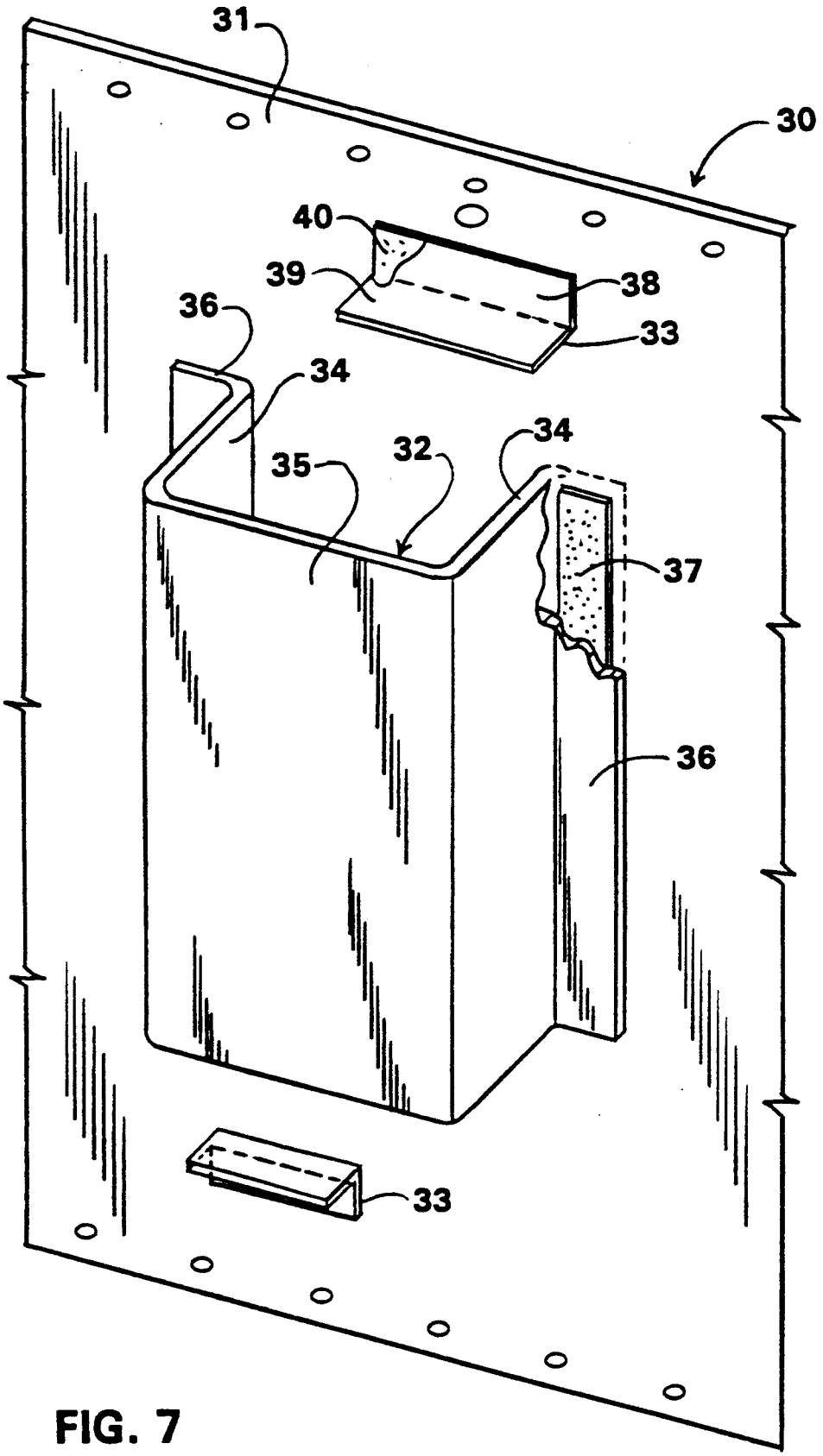
FIG. 7 is a perspective view of a section of another modified packaging system.

A modified packaging system designated generally by the numeral 30 is diagrammatically illustrated in FIG. 7. This modified system 30 includes an elongated carrier tape 31 on which are mounted a plurality of article-receiving loops 32. These loops are of a shape to form, in cooperation with the carrier tape, a tubular socket which receives and retains an article for transport and dispensing at a utilization station. This packaging system also includes a plurality of gating elements 33 which are mounted on the carrier tape with one of the gating elements disposed in axial alignment to a respective open end of a loop. In this embodiment, both ends of each loop are open, and thus, there is a gating element disposed at each of the two opposed ends.

The loops in this embodiment are each formed as a separate element and affixed to the surface of the carrier tape. These elements are formed of a generally U-shape having side legs 34 supporting an interconnecting web 35 in spaced relationship to the surface of the carrier tape. Each of the legs 34 is provided at one end with a base flange 36 adapted to be secured to a surface portion of the carrier tape. Securing of the loops to the carrier tape is effected by an adhesive 37 interposed between mating surfaces of each flange 36 and the carrier tape.

The gating elements 33 are elongated strips of L-shape cross-section having a base web 38 that is secured to the carrier tape and includes a plate 39 which projects in laterally outward relationship to the surface of the carrier tape. The dimension of the plate 39 is such that it will extend a sufficient distance from the surface of the carrier tape to be in effective blocking relationship to an end of a respective loop 32. Attachment of the gating elements is effected by adhesive 40 disposed between the opposed surfaces of the base web 38 and the adjacent surface of the carrier tape. The adhesive is of a type suitable for the particular materials utilized in forming of the gating elements and carrier tape. Each of the gating elements may also be advantageously formed with the plate 39 extending in angular relationship to the planar surface of the carrier tape.

Figure 8:
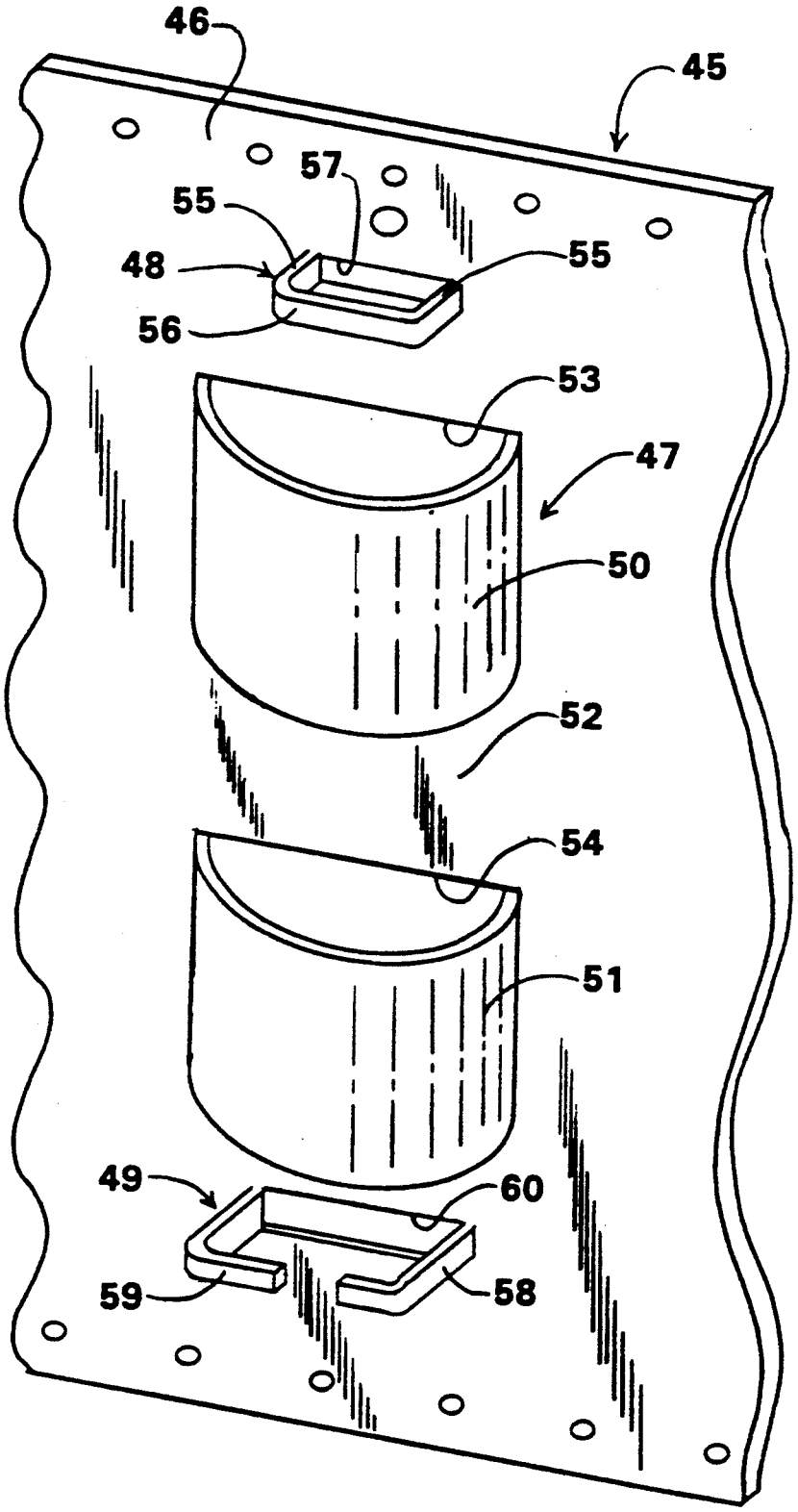
FIG. 8 is a perspective view of a section of another modified packaging system.

Another modified form of packaging system embodying this invention is diagrammatically illustrated in FIG. 8 and designated generally by the numeral 45. This modified system 45 also includes an elongated carrier tape 46 that is formed from a suitable plastic material to have the appropriate characteristics of structural rigidity and capability of being mechanically formed in conjunction with application of heat to result in forming of the respective configurations of loops and gating elements.

A plurality of article-receiving loops 47 are formed in longitudinally spaced relationship along the length of the carrier tape with each of the respective loops being spaced a short distance from adjacent loops and oriented in transversely extending relationship across the carrier tape. Again, these loops are open at each end and a respective gating element 48 and 49 is disposed in axially aligned, but outwardly spaced relationship, to a respective end of a loop 47.

In this embodiment of the packaging system, each article-receiving loop 47 is integrally formed with the carrier tape and in this particular embodiment, comprises a pair of similar loop elements 50 and 51. Each of the loop elements 50 and 51 is of a semicircular cross-section and they are arranged in axial alignment with their mutual axes extending transversely with respect to the carrier tape. Each loop element is formed through application of mechanical force such as by a die projected against the carrier tape with heat being applied to the tape concurrently during the time of application of mechanical force. These loops are thus formed in a position where there is a segment or web 52 of the carrier tape that extends between adjacent ends of the two loop's elements. This web 52 thus forms a part of each of the respective loops and enables the loops to receive elongated articles and retain those articles in packaged relationship on the carrier tape.

Alternatively to forming of the loop elements 50 and 51 by application of mechanical force and heat, these elements may be formed through a vacuum-forming process. Vacuum-forming may be readily utilized with particular types of plastic material that are of appropriate thicknesses. Vacuum-forming techniques are particularly suitable in fabricating loop elements of specific configurations adapted to interfit with articles having specific geometric shapes.

Each of the gating elements 48 and 49 may also be advantageously formed through use of mechanical-forming dies and the application of heat. The two gating elements are illustrated in FIG. 8 as being of slightly different configurations to specifically illustrate that these elements need not be of the same configuration at each end of an article-receiving loop. The one gating element 48 comprises a web 55 extending transversely across an end of a loop element 50 and supported in spaced relationship to the surface of the carrier tape on respective legs 56. This gating element being formed from the carrier tape itself thus leaves an aperture 57 in the carrier tape. The other gating element 49 may be similarly formed by use of an appropriately configured mechanical die, but it differs slightly in its configuration from the first described gating element. The gating element 49 is shown as being formed in two sections, each of which consist of an L-shaped component 58 and 59. These two components are formed out of the carrier tape, and thus, leave an aperture 60 in the tape. Regardless of the particular construction or configuration of the gating elements, each of these elements is displaced out of blocking relationship to the respective end of the adjacent loop element 50 or 51 through manipulation of the marginal edge portion of the carrier tape in the manner as is generally described with respect to FIG. 5. It will be recognized that the article-receiving loop 47 may be formed with more than the illustrated two loops and they may be of different axial lengths and the webs interposed between adjacent loops may also be of different widths.

Figure 9:
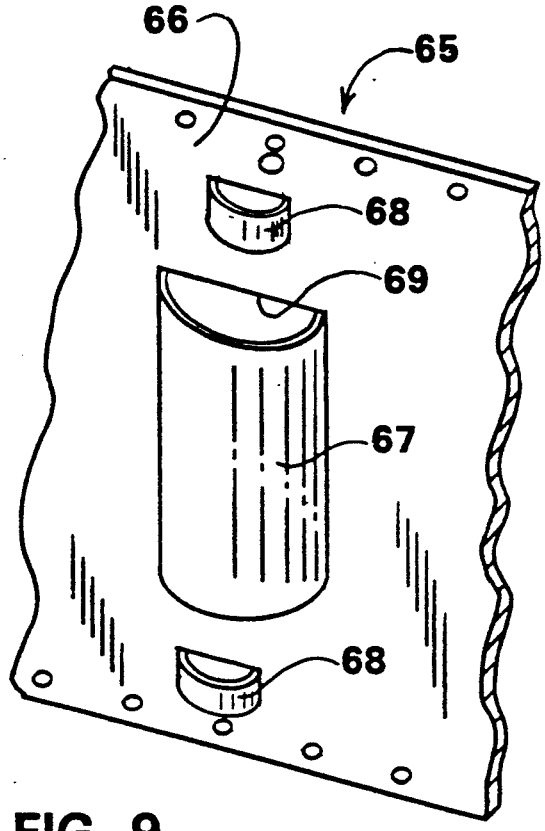
FIG. 9 is a perspective view of a section of another modified packaging system.
Figure 10:
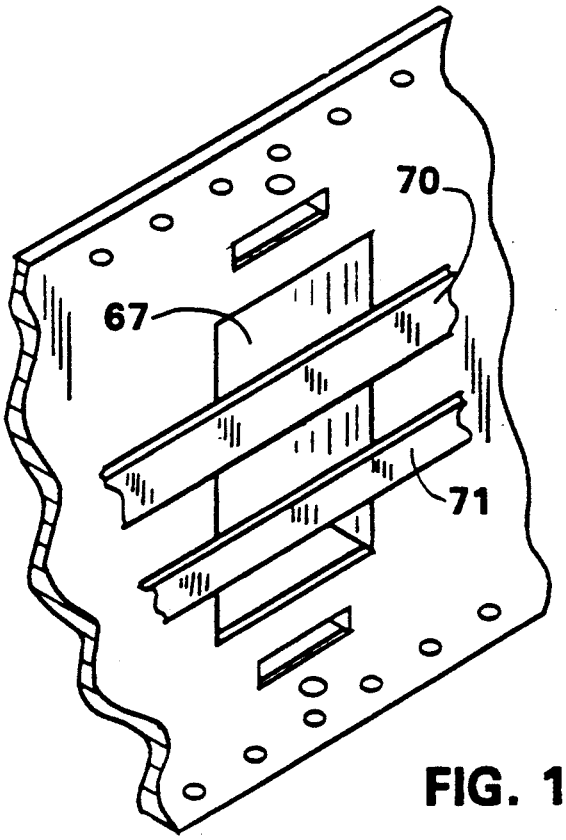
FIG. 10 is a perspective view of the rear of the packaging system shown in FIG. 9.

Another modified form of the packaging system embodying this invention is illustrated in FIGS. 9 and 10 and is generally designated by the numeral 65. This modified packaging system 65 is similar in a number of respects to the packaging system 45 illustrated in FIG. 8. The system shown in FIGS. 9 and 10 also includes an elongated carrier tape 66 and a plurality of article-receiving loops 67 disposed in longitudinally spaced relationship along the carrier tape. This system also includes a plurality of gating elements 68 that are formed with the tape and disposed in axial alignment with respective loops 67 for the purpose of blocking the loops to prevent exit of articles from or entrance into the respective loops.

In this embodiment, each of the article-receiving loops 67 is formed integrally from the carrier tape 66 and is of an axial length sufficient to form the entire loop. Fabrication techniques that may be utilized again include the mechanical die and heat combination as well as the vacuum-forming processes described in conjunction with the preceding illustrated and described embodiments. Each loop 67 which is thus formed out of the carrier tape results in formation of an aperture 69 that has an underlying same dimensional configuration as that of the loop. To retain the articles in association with the respective loop 67, one or more backing strips 70 and 71 are secured to the reverse side or face of the carrier tape 66. These backing strips are best seen in FIG. 10 and extend in longitudinally disposed relationship to the carrier tape. They are advantageously secured to the carrier tape by suitable adhesive with the portions extending across the aperture 69, thus being complemental to the loop 67 and cooperatively form with that loop a tubular receptacle for receiving the articles to be received and carried by this packaging system. The strips 70 and 71 are of appropriate widths and are positioned on the carrier tape to effectively cooperate in retaining an article in association with the respective loop.

The gating elements 68 are also integrally formed from the carrier tape 66. In this embodiment, they are shown as comprising elements of semicircular shape that may be formed by mechanical dies in association with heat to enable deformation of the carrier tape into the desired shape of the gating element.

Figure 11:
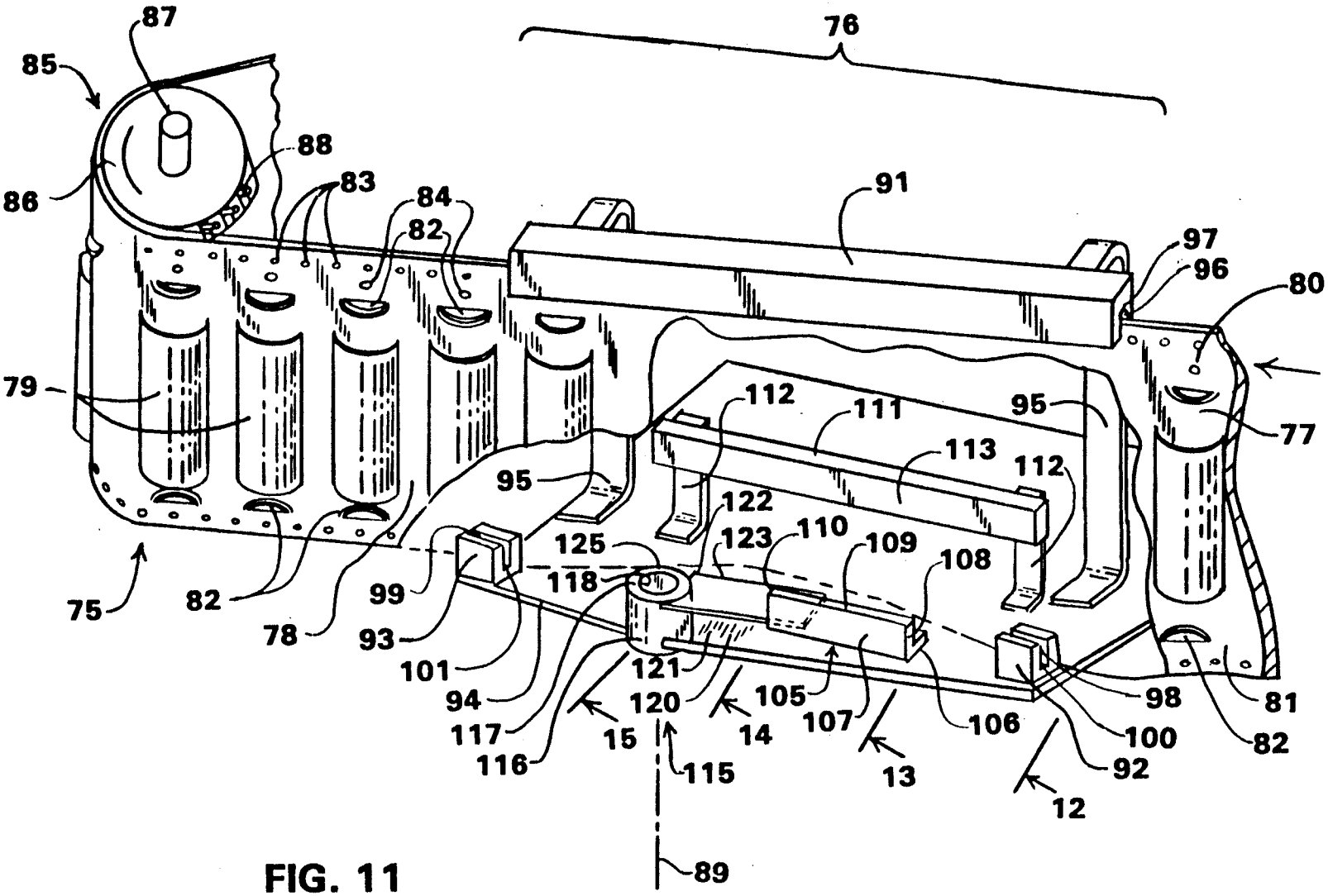
FIG. 11 is a diagrammatic illustration of the mechanical components for effecting automated manipulation of the carrier strip and its associated gating element.

A mechanism for effecting manipulation of a tape packaging system of this invention is diagrammatically illustrated in FIG. 11 and is a perspective view of a section of a packaging tape 75 as it passes through an article-transfer station designated generally by the numeral 76. The tape packaging system 75 embodies a construction which is illustrated and described in detail with respect to FIG. 6 of the drawings. It includes an elongated strip-form carrier tape 77 to which is attached a loop tape 78 forming a series a relatively spaced loops 79 for receiving and retaining articles. The loop tape 78 is of a transverse width that is less than the transverse width of the carrier tape 77, and thus, the open ends of the loops 79 are spaced a distance inwardly from each of the respective longitudinal edges 80 and 81 of the carrier tape. Gating elements 82 are disposed in longitudinally extending rows adjacent each of the opposite ends of the loops with one gating element being disposed in cooperative relationship to each end of the respective loops. A series of sprocket index holes 83 are formed in each marginal edge portion of the carrier tape and extend in parallel relationship to the respective longitudinal edges 80 and 81. An indexing aperture 84 is provided at each longitudinal axis of a respective loop 79 to enable automated control of the displacement of the carrier tape. These indexing apertures 84 cooperate with a sensor which is not illustrated or otherwise described to enable the apparatus to incrementally advance the carrier tape and precisely locate each of the loops 79 in sequence at a transfer point where an article may either be inserted into a loop or removed therefrom.

The packaging system 75 is shown in this diagrammatic illustration as being oriented with the carrier tape 77 disposed in a vertical plane and moving along a horizontally disposed longitudinal axis. Longitudinal displacement of the carrier tape 77 is effected by a drive mechanism 85 which includes a pair of sprocket wheels 86 that are mounted on a common drive axle 87 that is journalled in respective bearings and mechanically coupled to a drive apparatus. Neither the bearings nor the drive apparatus are illustrated or otherwise described as their structure is well-known to those skilled in this particular art. It will be sufficient to note that the drive apparatus is of a type that receives an input signal generated by a sensor device cooperating with the indexing apertures 84 to effect incremental rotation of the sprocket wheels 86. Each of the sprocket wheels includes a plurality of sprocket pins 88 angularly disposed around its periphery in uniformly spaced relationship. These sprocket pins 88 are of a configuration and size to cooperatively project through respective index holes 83 and to effect longitudinal displacement of the carrier tape. Rotation of the sprocket wheels 86 is effected by operation of the drive apparatus which is designed to incrementally advance the carrier tape 77 along its longitudinal path and to sequentially position each of the loops 79 at a transfer point which is indicated by the broken line identified by the numeral 89. The drive apparatus functions to maintain each of the loops at this transfer point for a predetermined length of time that is sufficient for either loading of an article into the respective loop or to enable its withdrawal. The carrier tape 77 is wrapped around a portion of the respective sprocket wheels 86 that is sufficient to assure that the drive mechanism 85 will be fully operable to effect the longitudinal displacement of the carrier tape. It will be understood that other components will be provided for support of the carrier tape as well as guidance in its direction of movement. It will be further understood that the tape packaging system 75 will be provided from a suitable supply source such as a storage reel or a container of the packaging system folded into overlapping loops and that the packaging system, once it has passed through the article-transfer station 76 will then thereafter either be placed in a receiving container or subjected to disposal operations suitable for the particular system.

A tape-manipulating apparatus generally designated by the numeral 90 is shown in operative relationship with the packaging system 75 and located in the region of the article-transfer station 76. This illustrated and described embodiment of tape-manipulating apparatus 90 is designed for mechanical operation on the packaging system 75 and is adapted, in particular, for gravity displacing of the articles. This specific embodiment of the manipulating apparatus 90 also is specifically configured and shown in relative relationship to the packaging system for effecting dispensing of the articles from the loops 79. While the apparatus is shown in FIG. 7 for effecting dispensing of the articles, it will be understood that this particular embodiment may also be adapted and located with respect to the packaging system to enable loading of articles into the loops. This apparatus is designed to effect manipulation of the carrier tape 77 and the gating elements 82 so as to displace the gating elements to a position where they are in a non-interfering position with respect to the axial path of an article either into or out of a respective loop.

Included in the tape-manipulating apparatus 90 are tape guide and support means which are operative to maintain the carrier tape 77 in a planar orientation as it passes through the transfer station as well as to prevent its lateral displacement in the plane of the tape. This means for fixing the tape in a desired orientation as it traverses the transfer station includes an upper guide rail 91 and a pair of longitudinally spaced lower guide rail elements 92 and 93. These guide rails are mounted on a base support plate 94 that is fixed to other supporting structure that is otherwise not disclosed or described as the mechanics of providing a suitable support are known to those skilled in this particular art. It is sufficient for the purposes of this disclosure to recognize that the base support plate would be maintained in a fixed horizontally oriented position in closely underlying relationship to the bottom longitudinal edge 81 of the carrier tape. Supporting the upper guide rail in overlying relationship to the support plate are vertically extending brackets 95 which are secured at their lower end to the base support plate and are secured at their upper ends to the guide rail 91 in longitudinally spaced relationship. The upper guide rail 91 is formed from an elongated rigid bar having a length sufficient to extend substantially the entire extent of the article-transfer station. Formed in the rail and also extending its entire length is a slot 96 which is of a configuration to receive a marginal edge portion of the carrier tape 77. Surfaces of the vertical walls of the slot may be tapered or arcuately curved at the leading end to facilitate entrance of the carrier tape. The bottom wall 97 of the slot rides against the longitudinal edge 80 of the carrier tape and functions to prevent displacement of the tape laterally with respect to the plane of the tape. Thus, this guide rail functions to maintain the upper marginal edge portion of the carrier tape in a flat plane and to prevent its upward displacement. Each of the two lower guide rail elements 92 and 93 are secured to the base support plate 94 in longitudinally spaced relationship and are located respectively at the entrance and exit ends of the transfer station. Each of the guide rail elements 92 and 93 is formed with an upwardly opening slot 98 and 99 with respective bottom walls 100 and 101 of each slot engaging the bottom longitudinal edge 81 of the carrier tape 77 to provide the necessary vertical support. Each of the slots 98 and 99 may also have the leading sidewall portions of each tapered or rounded to facilitate entry of the carrier tape 77 into the slot. These guide rails, both upper and lower, thus cooperate in fixing the carrier tape 77 in a substantially planar orientation and to prevent its movement laterally in a transverse direction to its longitudinal axis. The spaced relationship of the lower guide rail elements 92 and 93 permits the lower marginal edge portion of the carrier tape that is located at any particular time between those elements to be flexed in performance of the manipulating operation to permit axial displacement of an article from or into a respective loop.

Flexing of the lower marginal edge portion of the carrier tape 77 is primarily effected in this embodiment by a bending rail 105. This bending rail is of L-shaped configuration in cross-section having a bottom flange 106 and an upstanding plate 107. The bottom flange 106 provides a means for rigidly securing the rail to the base support plate 94. The rail is oriented with its plate 107 disposed in angular relationship to the normal plane of the carrier tape 77 with the leading end 108 being positioned to permit the carrier tape to pass by that end as the plate has a vertical extent such that it will project a distance laterally over the marginal edge portion of the carrier tape. Not only is the bending rail oriented in angular relationship to the normal planar path of movement of the carrier tape, but it is configured with its upper edge 109 inclined in a relatively upward direction from the leading end 108. This configuration of the bending rail plate can be best understood by reference to the sequential step illustrations of FIGS. 12–14.

Figure 12:
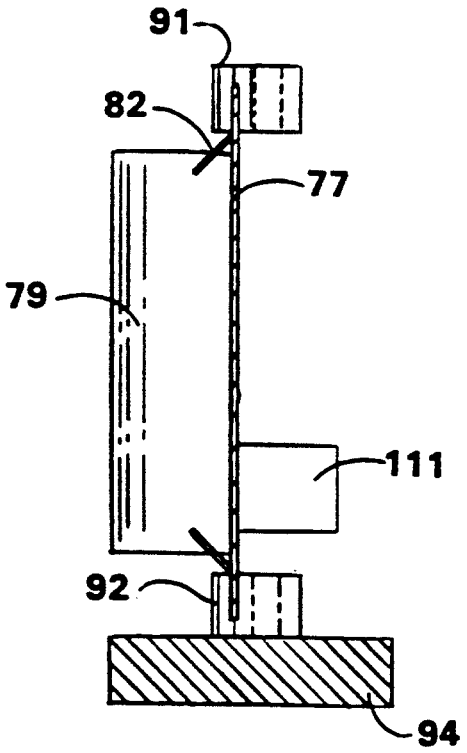
FIGS. 12, 13, 14 and 15 are diagrammatic sectional views of the packaging system at respective ones of four stages of manipulation as it passes through the mechanism of FIG. 11.
Figure 13:
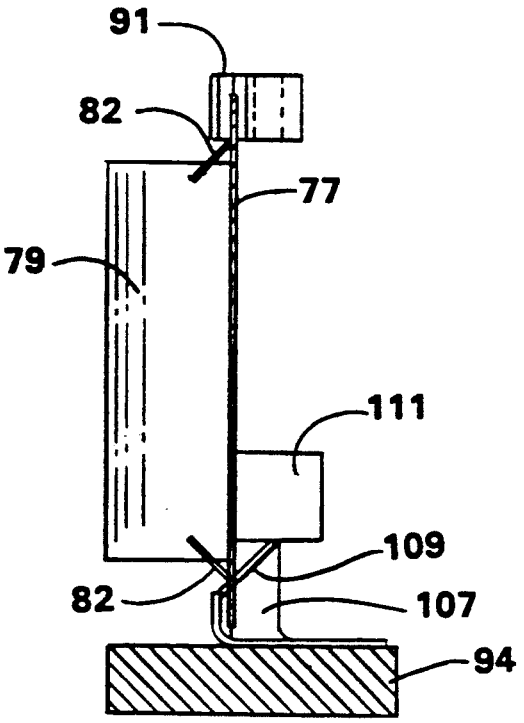
Figure 14:
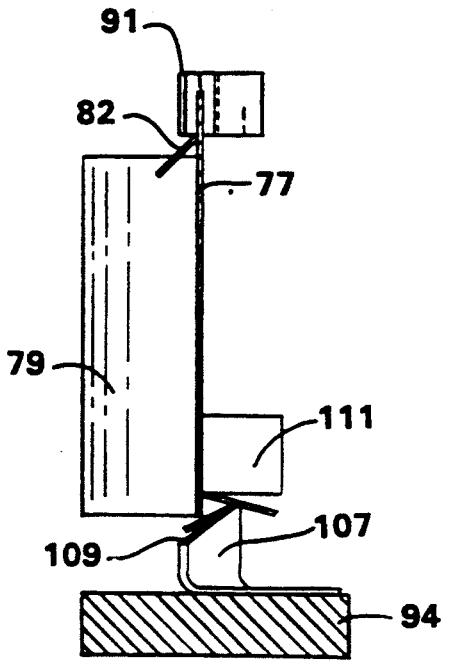

Functioning of the bending rail can be described as effecting a lateral flexing of the marginal edge portion of the carrier tape. As can be seen in FIGS. 12, 13 and 14, it functions to displace that marginal edge portion of the carrier tape in a direction laterally out of its normal, flat planar orientation. It thus displaces the carrier tape laterally while concurrently at the successive positions as shown in FIGS. 12, 13 and 14, push the marginal edge portion in an upward direction. The consequence of this lateral and upward displacement is to flex the marginal edge portion of the tape into a complex curved shape until it reaches the terminal end 110 of the rail's plate 107. Referring to FIG. 11, it will be seen that the bending rail 105 is of a length such that it extends from a point closely adjacent to the terminal end of the first lower guide rail element 92 to a point that is closely adjacent to a vertical plane extending transversely to the plane of the carrier tape and extending through the axes of the transfer point 89. It will be noted in FIGS. 12, 13 and 14 that this flexing of the marginal edge portion of the carrier tape concurrently results in displacement of the gating elements 82. The extent of flexing of the carrier tape is sufficient to displace the gating element to a position where it is not in interfering relationship to the open end of a respective loop 79 when that loop is at the transfer point 89.

Since the carrier tape 77 must otherwise be maintained in its planar configuration so as to assure that the loops 79 will be properly oriented as they pass the transfer point 89, it is advantageous to provide a back-up rail 111. This back-rail 111 is supported on the base support plate 94 in upwardly spaced relationship thereto by a pair of mounting brackets 112. These brackets support the rail at an elevation where it will contactingly engage the back surface of the carrier tape 78 at a location which coincides with the lower ends of the loops 79. This back-up rail 111 is formed with a forwardly facing flat surface 113 which bears against the rear surface of the carrier tape. It will be noted at this point, that this back-up rail will also function with packaging systems constructed as is shown in FIG. 1. With a packaging system of that construction, the attaching loops 15, which project a distance rearwardly from the back surface of the carrier tape 11, are adapted to ride along the forwardly facing surface 113 of the back-up rail. To enable the apparatus to function with the packaging system of that configuration, it is only necessary to appropriately position the back-up rail at an appropriate vertical and rearward position to cooperate with the opposed surfaces of a series of attaching loops as they pass through the transfer station.

Figure 15:
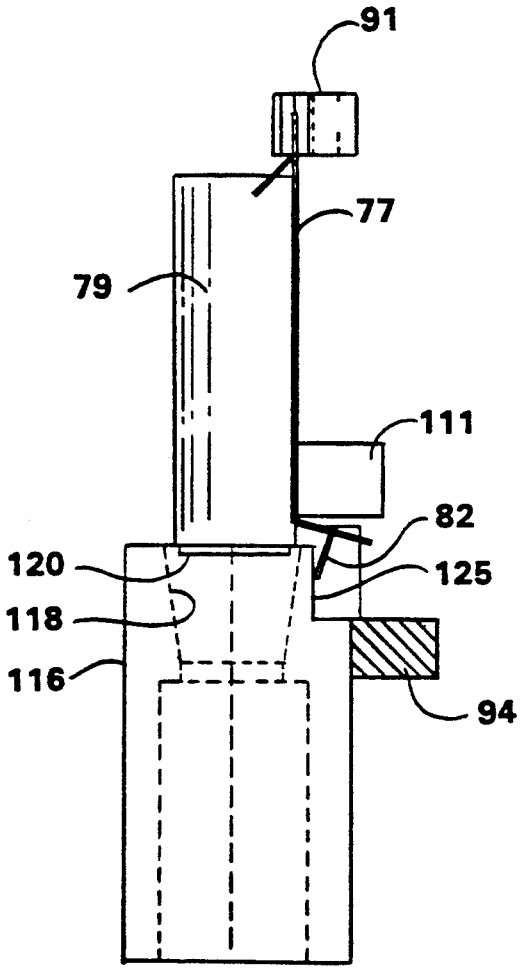

A dispensing guide mechanism 115 is provided in combination with the tape manipulating apparatus 90 to assure that the articles, as they are dispensed from the respective loops 79, will be at least initially directed along the axis of the transfer point 89. This dispensing guide mechanism 115 includes a pass tube 116 which is carried by the base support plate 94 in a vertical orientation with its upper end 117 lying in a horizontal plane that coincides with the lower ends of the loops 79 as they pass through the transfer station 76. This relative arrangement can be best seen in FIG. 15. The pass tube 116 is formed with a central passageway 118 which, in FIG. 11, is shown as being of circular cross-section. This passage 118 may have an upper end portion that is of tapered configuration as is diagrammatically shown in FIG. 15 to better assure that articles as they exit from a respective loop will enter into and move through the passage. It is advantageous to have the lower portion of the passage 118 of a diameter that more closely corresponds to the size of the article to provide better directional capability and deposit the article at a precise location. Although not shown in these drawings, the pass tube may be connected to other conveying tubes or mechanisms to direct and place the article at a precise location.

A stop plate 120 is also included with the dispensing guide mechanism 115. This stop plate 120 is mounted on brackets 121 which are of a size to maintain the stop plate at an elevation and in a horizontal plane that essentially coincides with the plane of movement of the bottom ends of the loops 79. One end of the plate is formed with an arcuate shape 122 that coincides with the exterior surface of the pass tube 116. The width of the stop plate 120 is such that its inner longitudinal edge 123 will not extend to a position where it will interfere with the gating elements 82. As the tape 77 moves through the transfer station, the bottom ends of the loops 79 are successively brought into association with the stop plate 120 and as the gating elements are displaced out of an effective position with respect to the respective loops, the stop plate will assure that the articles will not be prematurely enabled to exit from the loop and will be retained in the loop until they are in alignment with the central passage 118 of the pass tube.

Figure 16:
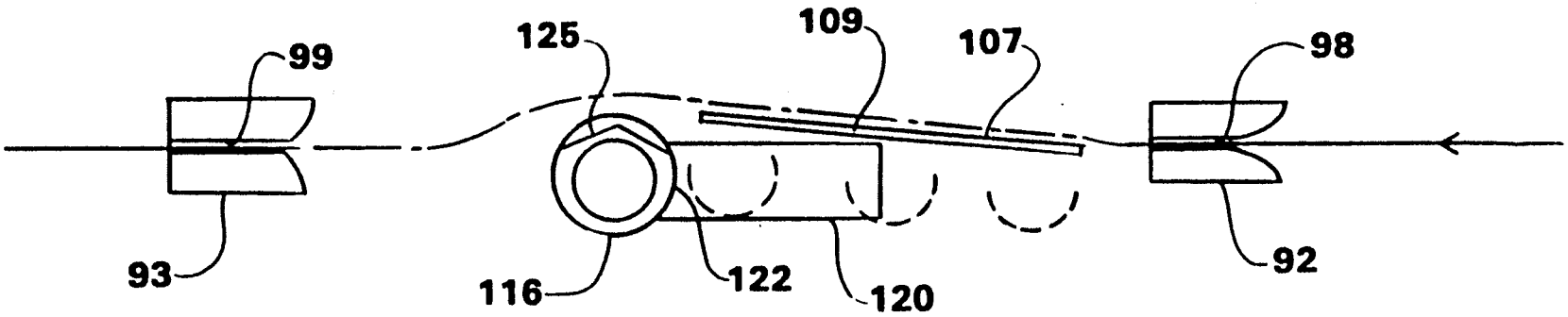
FIG. 16 is a fragmentary sectional view taken along a plane defined by line 16—16 in FIG. 11.

To further assure that the gating elements 82 will be completely displaced out of interfering relationship to the path of movement of articles exiting from the loops 79, the upper end portion of the pass tube 116 is formed with a profiled surface 125. This profiled surface is formed by reducing the thickness of the tubular wall of the pass tube around a portion of its circumference and, in particular, in the region that extends from a point facing in the direction from which the carrier tape 77 approaches the pass tube to a point that is in a trailing direction from the leading point as seen in FIG. 16. As can be best seen in FIG. 15, the gating elements 82 are located in a position where they will engage this profiled surface 125 as the respective portion of the carrier tape 77 transitions from the terminal end 110 of the bending rail 105. The effect of this profiled surface is to further effect displacement of the gating elements in a manner that is independent of the flexing of the marginal edge portion of the carrier tape.

After the carrier tape progresses to a point where the related section has passed the pass tube, the marginal edge portion will then gradually return to the planar configuration. At this point, the carrier tape 77 is directed through the rear guide rail element 93 and continues its displacement along the prescribed path.

It will be readily apparent that a packaging system of particularly useful construction is provided by this invention. The gated loops provide an advantageous means for assuring that the articles will be retained in the loops and to also provide for precise dispensing of those articles at a particular point of utilization. Manipulation of the packaging systems is readily effected by the manipulating apparatus that is provided for utilization with this packaging system. Through flexing of the marginal edge portion of a carrier tape, it is possible to easily displace the gating elements out of interfering relationship to the path of movement of articles, either into or out of the respective loops. The apparatus also includes a dispensing guide mechanism to further assure that the articles will be delivered at a precise point for further handling.

Having thus described this invention, what is claimed is:

1. A gated-loop tape packaging system for articles comprising an elongated flexible carrier tape of planar strip-form having opposed faces and predetermined width having longitudinally extending edges, a plurality of elongated article-receiving loops carried on said carrier tape on one of its faces in serially disposed, relatively spaced relationship along the longitudinal axis of said carrier tape, each of said loops being of elongated configuration oriented with its longitudinal axis extending transversely to the longitudinal axis of said carrier tape and being open at least at one end to permit passage of an article into or out of said loop through said open end, said loops being positioned on said carrier tape with the open ends thereof spaced a distance inwardly from a respective adjacent longitudinal edge of said carrier tape, and a plurality of gating elements carried by said carrier tape with one of said gating elements disposed between an open end of each loop and the adjacent longitudinal edge of said carrier tape in blocking relationship to the open end of a respective loop to prevent axial displacement of an article with respect to that loop, said gating elements being located at a position intermediate the axial end of a respective loop and the adjacent longitudinal edge of said carrier tape and of a configuration to project a predetermined distance laterally from the face of said carrier tape whereby bending of the marginal edge portion of said carrier tape about a longitudinal axis with respect to the carrier tape and located intermediate said loop and longitudinal edge of said carrier tape to a predetermined extent of substantially less than at right angles out of its plane and in a direction away from the face of said carrier tape on which said loops are carried displaces the gating element out of blocking relationship with respect to the associated loop, thereby permitting axial displacement of an article into or out of said loop.

2. A tape packaging system according to claim 1 wherein said loops are open at both ends.

3. A tape packaging system according to claim 1 wherein said loops are formed in an elongated flexible tape.

4. A tape packaging system according to claim 1 wherein said loops are secured to said carrier tape by mechanical interlocking means.

5. A tape packaging system according to claim 1 wherein said loops are secured to said carrier tape by bonding means.

6. A tape packaging system according to claim 5 wherein said bonding means is an adhesive.

7. A tape packaging system according to claim 1 wherein said loops are each formed as a separate element and secured to said carrier tape by bonding means.

8. A tape packaging system according to claim 1 wherein said loops include a plurality of sections disposed in axially aligned, relatively spaced relationship.

9. A tape packaging system according to claim 8 wherein said loops are integrally formed in said carrier tape.

10. A tape packaging system according to claim 1 wherein said loops are integrally formed with said carrier tape from a portion of said tape displaced out of the web of the tape into a loop-shaped configuration, and including closing means secured to said carrier tape for at least partially closing a base of said loops.

11. A tape packaging system according to claim 10 wherein said closing means includes at least one elongated, flexible closing tape secured to said carrier tape on a face thereof opposite to the face from which said loops project, said closing tape extending longitudinally of said carrier tape.

12. A tape packaging system according to claim 1 wherein said gating elements are integrally formed with said carrier tape.

13. A tape packaging system according to claim 1 wherein said gating elements include a plate-form member disposed in laterally outward projecting relationship to said carrier tape.

14. A tape packaging system according to claim 13 wherein said plate-form members of said gating elements are oriented to extend in parallel relationship to the longitudinal axis of said carrier tape.

15. A tape packaging system according to claim 1 wherein said gating elements are secured to said carrier tape by bonding means.

16. A tape-manipulating apparatus for a tape-form article packaging system having an elongated, flat strip carrier tape with longitudinally extending edges and provided with a plurality of elongated article-retaining loops carried on the tape and gating elements carried on the tape in cooperative relationship to the loops for displacement between a position blocking movement of articles into or out of a respective loop and a non-blocking position where they do not block movement of articles, the tape-manipulating apparatus being positioned at an article-transfer station where the packaging system is longitudinally advanced therethrough for enabling entrance or exit of an article with respect to a loop at an article-transfer point located within the article-transfer station and comprising guide means for mechanically engaging the carrier tape at opposite longitudinal edges and restraining the tape against displacement in the plane of the carrier tape and transversely to the tape's longitudinal axis while the respective portion of the tape is in the article-transfer station, tape bending means mechanically engageable with the carrier tape for laterally displacing a marginal edge portion of the carrier tape and to displace a gating element toward a position out of blocking relationship to a respective loop while the loop is at the article-transfer point.

17. A tape-manipulating apparatus according to claim 16 wherein said bending means includes an elongated bending rail disposed in longitudinally extending relationship to the path of movement of the carrier tape and having a tape-contacting surface configured to contactingly engage a face surface of the carrier tape as the tape traverses the article-transfer station and progressively displace a marginal edge portion of the tape laterally out of the plane of the tape whereby the gating element for a respective loop is displaced out of blocking relationship to that loop at the article-transfer point.

18. A tape-manipulating apparatus according to claim 17 wherein said bending rail includes a rigid plate supported in a fixed position with respect to the path of movement of the tape, said plate formed with a bending edge having said tape-contacting surface, said bending edge angularly oriented with respect to a first point at the plane of the tape to extend from the plane of the tape to a second point laterally offset from the plane of the tape in a direction away from the side on which the loops are carried and in the direction of movement of the tape.

19. A tape-manipulating apparatus according to claim 18 wherein said bending edge is oriented to extend a distance from said first point in a direction relatively inward with respect to the one longitudinal edge of the tape to said second point.

20. A tape-manipulating apparatus according to claim 19 wherein said first point is disposed at the line of the path of movement of the tape's longitudinal edge.

21. A tape-manipulating apparatus according to claim 17 wherein said guide means includes a first elongated guide rail disposed to engage with one longitudinal edge of the tape and extending substantially the length of the article-transfer station and two guide rail elements disposed to engage with the other longitudinal edge of the tape, one of said guide rail elements disposed in preceding relationship to said bending rail and the other of said guide rail elements disposed in trailing relationship.

22. A tape-manipulating apparatus according to claim 21 wherein said guide rail and said guide rail elements each have a guide slot formed therein for receiving a marginal edge portion of the tape in edgewise relationship, said slots having a bottom surface engageable with a respective longitudinal edge of a tape and sidewall surfaces engageable with respective face surfaces of the tape.

23. A tape-manipulating apparatus according to claim 22 wherein said guide rail and guide rail elements are spaced a distance transversely apart with respect to the longitudinal path of movement of the tape to place the bottom surfaces of the slots in contacting engagement with the tape's longitudinal edge.

24. A tape-manipulating apparatus according to claim 22 wherein the sidewall surfaces of said guide rail and guide rail element slots are spaced apart a distance substantially equal to the thickness of the tape.

25. A tape-manipulating apparatus according to claim 17 which includes an elongated back-up rail supported in fixed relationship to said bending rail to limit lateral displacement of the tape, said back-up rail positioned to engage the face of the carrier tape opposite the tape's face engaged by said bending rail.

26. A tape-manipulating apparatus according to claim 17 which includes gating element bending means positioned at the article-transfer point and mechanically engageable with the gating elements to laterally displace the gating elements out of axial alignment with respect to respective loops.

27. A tape-manipulating apparatus according to claim 26 wherein said gating element bending means includes a bending surface disposed in following relationship to said bending rail with respect to displacement of the tape through the article-transfer station, said bending surface configured to contactingly engage with the gating elements as they are progressively displaced longitudinally through the transfer station.

28. A tape-manipulating apparatus according to claim 17 which includes dispensing guide means for guiding of an article along a predetermined path upon exit of the article from a loop of the tape packaging system at the article-transfer point, said dispensing guide means supported in operative relationship to the tape packaging system to receive the articles as they exit from the packaging system's loops.

29. A tape-manipulating apparatus according to claim 28 wherein said dispensing guide means includes an elongated pass tube having an entrance end positioned in axial alignment with a loop at the article-transfer point.

30. A tape-manipulating apparatus according to claim 17 which includes a stop plate positioned in preceding relationship to the article-transfer point, said stop plate being of elongated configuration and predetermined width disposed in longitudinal alignment with the path of movement of the carrier tape and in orthogonal orientation to the axial path of displacement of articles from the loops and positioned to prevent axial displacement of the articles from a loop until the loop reaches the article-transfer point.

31. In combination with the tape-manipulating apparatus of claim 16, a tape-displacing means adapted to engage with a carrier tape and selectively operable to displace the tape along a longitudinal path.

* * * * *